US006543126B1

(12) United States Patent
Hamlin

(10) Patent No.: US 6,543,126 B1
(45) Date of Patent: Apr. 8, 2003

(54) MACHINE FOR REMOVING AND LOADING A FLAT ROOF

(76) Inventor: H. Lee Hamlin, 2935 Broadway, Macon, GA (US) 31206

( * ) Notice: Subject to any disclaimer, the term of this patent is extended or adjusted under 35 U.S.C. 154(b) by 0 days.

(21) Appl. No.: 09/684,043

(22) Filed: May 2, 2000

Related U.S. Application Data

(63) Continuation-in-part of application No. 09/178,337, filed on Oct. 23, 1998, now abandoned.
(60) Provisional application No. 60/063,013, filed on Oct. 23, 1997.

(51) Int. Cl.[7] ..... B23P 19/00; E21C 25/00
(52) U.S. Cl. ..... 29/822; 299/36.1
(58) Field of Search ..... 29/822; 299/36, 299/36.1, 37.1, 37.3; 15/93.1; 198/518; 30/170; 37/232, 237

(56) References Cited

U.S. PATENT DOCUMENTS

| | | | | | |
|---|---|---|---|---|---|
| 3,903,565 | A | * | 9/1975 | Hicks | 15/352 |
| 4,053,183 | A | * | 10/1977 | Probst | 299/36 |
| 5,490,755 | A | * | 2/1996 | Billotte | 414/550 |
| 5,741,047 | A | * | 4/1998 | Ordonez | 299/37.1 |
| 5,772,284 | A | * | 6/1998 | Lindsey et al. | 299/36.1 |

* cited by examiner

*Primary Examiner*—I Cuda-Rosenbaum
*Assistant Examiner*—John C. Hong
(74) *Attorney, Agent, or Firm*—Harry I. Leon; Vivian L. Steadman

(57) ABSTRACT

A machine which greatly reduces the labor required for repairing flat roofs on commercial and industrial buildings. Formerly, old roofing material usually had to be removed manually from the roof deck before new material could be installed. Removal of this old material was the most labor intensive part of the job. The present labor-reducing machine not only scrapes off the old roofing from the roof deck but also loads any material so scraped into a cart for removal from the roof. The machine comprises a pair of drive wheels, a flat conveyor belt, and a chisel-like front member. To begin the removal process, the latter is first wedged between the old roofing material and the roof deck; and then the drive wheels are used to push the chisel-like front member, when it so wedged, forward. The flat belt conveyor is mounted in close proximity to the front member so that as the old roofing material is being dislodged, it is directed onto the belt. The conveyor belt then transports the old roofing material rearwardly and upwardly and drops it into a cart. To facilitate this operation, the roofing is preferably scored, prior to removal, in about three foot square sections, so that the roofing material tends to break into chunks more easily as it ascends the conveyor. Wheels for propelling the machine itself are independently driven and used for steering, providing it with a very short turning radius. Coupled with direct steering linkage are controls for reversing direction, making this machine highly maneuverable on the job.

3 Claims, 5 Drawing Sheets

MACHINE FOR REMOVING AND LOADING A FLAT ROOF

PREVIOUS APPLICATION

This application is a continuation-in-part of application Ser. No. 09/178,337, filed on Oct. 23, 1998, now abandoned.

Provisional application Serial No. 60/063,013 was filed on Oct. 23, 1997; and a request is hereby made for priority under 35 U.S.C. 119(e).

BACKGROUND OF THE INVENTION

This invention relates to the repair of flat roofs. Typically formed as a built-up composite of one or more of the following materials: asphalt, roofing paper, felt, rubber, plastic, fiberglass, gravel and insulation, these roofs may vary. in thickness from ½ inch to more than 2 feet thick. In the thickest of these roofs, much of their bulk is associated with multiple layers of insulation.

Whenever a flat roof needs to be replaced—whether because of wear or other physical damage, one must usually remove the old roof from the roof deck first. But removing it is the most labor intensive part of a conventional roofing job. Since the manual removal of old roofing material is such a strenuous, back-breaking job, it has been hard to find good workers willing to do this type of work for any extended period of time. Exacerbating this situation has been the fact that the longer a job takes the more likelihood there is it will rain, making time of the essence in completing any roofing project. Roofing contractors have long sought a way to save both on labor cost and on the time required to complete a roofing job.

SUMMARY OF THE INVENTION

The primary object of this invention is to provide an easy-to-use, self-propelled machine of small turning radius, which can be used to scrape off old roofing material from a roof deck and then transfer this material, in one continuous operation and without manually handling it, to an open cart. The cart, which may be of the type commonly used by roofers, is then moved to the edge of the roof and dumped, preferably directly into the bed of a truck parked near the building.

In accordance with the present invention, there is provided a machine which comprises a frame, a pair of wheels rotatably connected to the frame, a chute, an inclined flat conveyor belt movably mounted thereon, a short ramp, and a lower front member having a chisel-like front edge and a generally flat upper surface. Rigidly attached to the front member, the ramp extends rearwardly over the lower end of the conveyor belt.

In the lower front member, the flat upper surface, which extends rearwardly of the chisel-like front edge, is disposed generally horizontally and at slightly less of an incline than the front edge itself. In use, the entire lower front member is employed as a wedge. Instead of being used in a scraping action to remove old roofing, the lower front member is forced, for a considerable distance, between the old roofing material and a roof deck, thereby prying loose roofing in the process.

By so wedging the lower front member between the roof and the roof deck and then driving the machine forward, one can utilize it to pry large pieces of roofing material free of the roof deck. Moreover, the action of the lower front member, whereby nails are pried out rather than being sheared off, enables this improved machine to remove large pieces of roofing even in situations in which it is heavily nailed. For ease of operation, it is recommended that a roof which is about to be removed be scored into squares, each of which has a width which is less than that of the conveyor belt. Preferably, the squares measure about 3 feet by 3 feet.

As the machine moves forward, loosened roofing material slides across the short ramp and onto the flat conveyor belt. The conveyor then moves the squares of the old roofing material upwardly and away from the cutting edge of the chisel-like front member. At the distal end of the conveyor belt, this material is transferred to a chute which is directly downwardly and, from it, falls under the force of gravity into an open cart. In the preferred embodiment, the cart is drawn by the machine as it being loaded. When the cart has been filled, it is moved to the edge of the roof for emptying; and another cart is positioned under the discharge chute of the machine.

The machine further comprises means, including a pair of control levers with handles, for controlling the motion of the wheeled frame. In use, an operator walks behind and to one side of the machine. From this vantage point, he can observe the action of the chisel-like front member as its cutting edge enters into the roofing material, as well as the movement of old roofing material up the conveyor and into the cart. He can also control the machine by suitably manipulating the control levers. Forward motion of the machine is achieved by pushing both handles forward. The harder the push, the greater the speed. And, if the operator pulls both handles backward, the machine goes into reverse. To turn the machine, the operator pushes on the handle furthest from the side in the direction he wishes to turn and pulls the other handle; to turn in the opposite direction, he reverses this operation, pulling the handle which had been pushed and vice versa. In an alternate embodiment, means for controlling the motion of the wheeled frame comprises a joy stick control.

The machine still further includes a hydraulic power system having a hydraulic pump, an engine for driving this pump, a hydrostatic transmission, and two sets of hydraulic motors. The hydraulic power system insures that the machine operates reliably even under the extremely dusty conditions produced when old roofing material is dislodged and dropped into a cart. One of these sets of hydraulic motors is used to drive the wheels which support the frame. Operated independently of each other, the two hydraulic motors linked to this pair of drive wheels give the machine maximum traction and flexibility of operation. Another set of hydraulic motors is used to move the conveyor belt.

In an alternate embodiment, an electric motor, instead of an engine, is used to drive the hydraulic pump. Switching from an engine to an electric motor can be readily accomplished with this machine by connecting the power unit to the hydraulic pump.

In another alternate embodiment, the engine is mounted above the conveyor belt on a bracket attached to the wheeled frame, with the engine being mounted in such a way as to both lower the amount of roof dust impinging on the engine and keep more weight above the chisel-like front member of the machine.

A modification of the machine which includes means for adjusting the angle at which the conveyor belt is held relative to the surface of the roof is under development. Experience has shown that the optimum setting for this angle varies from 15 to 60 degrees, depending upon the type of roofing material.

DETAILED DESCRIPTION OF THE PREFERRED EMBODIMENT

Figure 1:
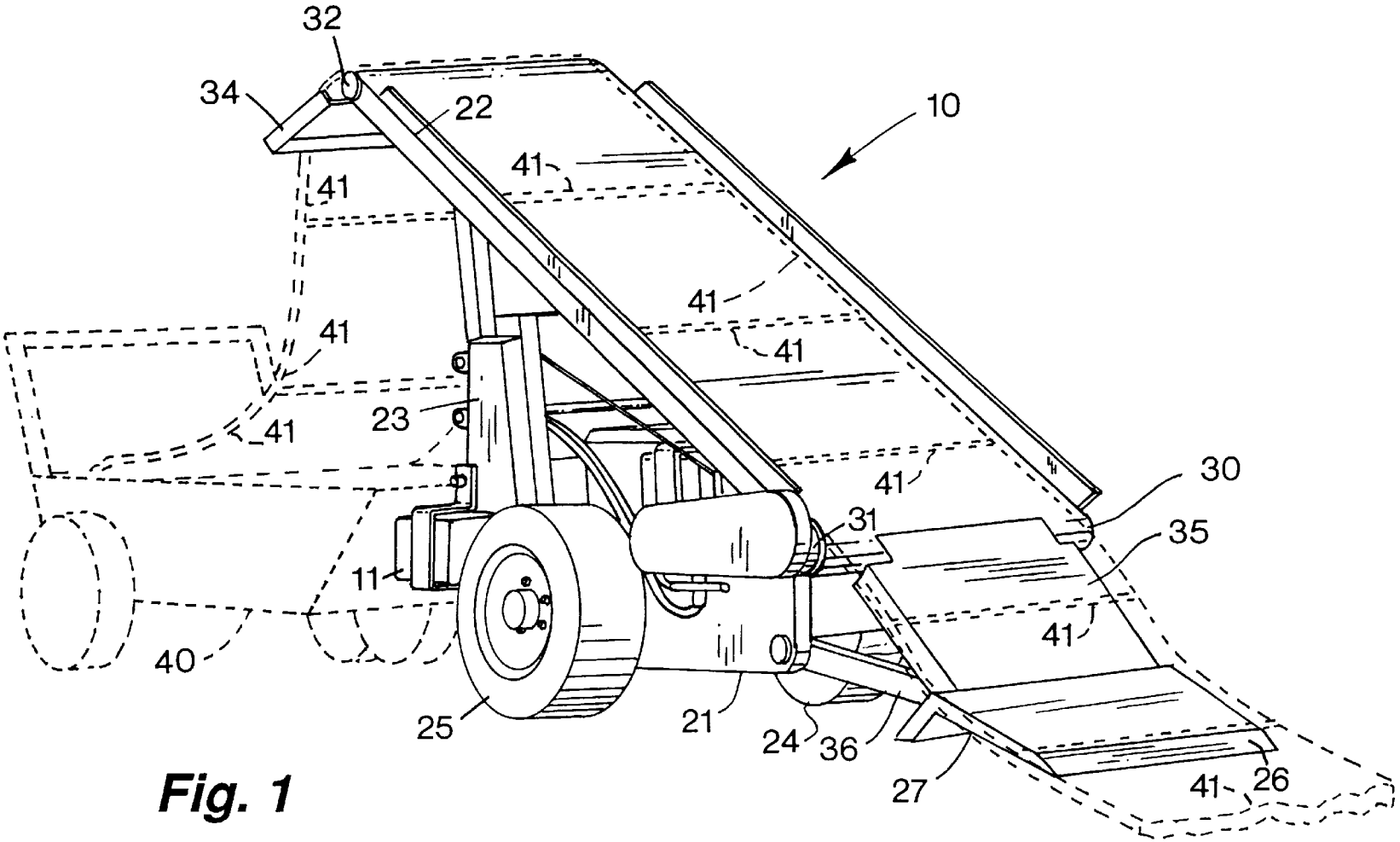
FIG. 1 is a perspective view of the machine according to the present invention, the machine being shown in operation, the removed roofing material and cart being shown in dashed lines for illustrative purposes only and forming no part of the claimed combination.
Figure 2:
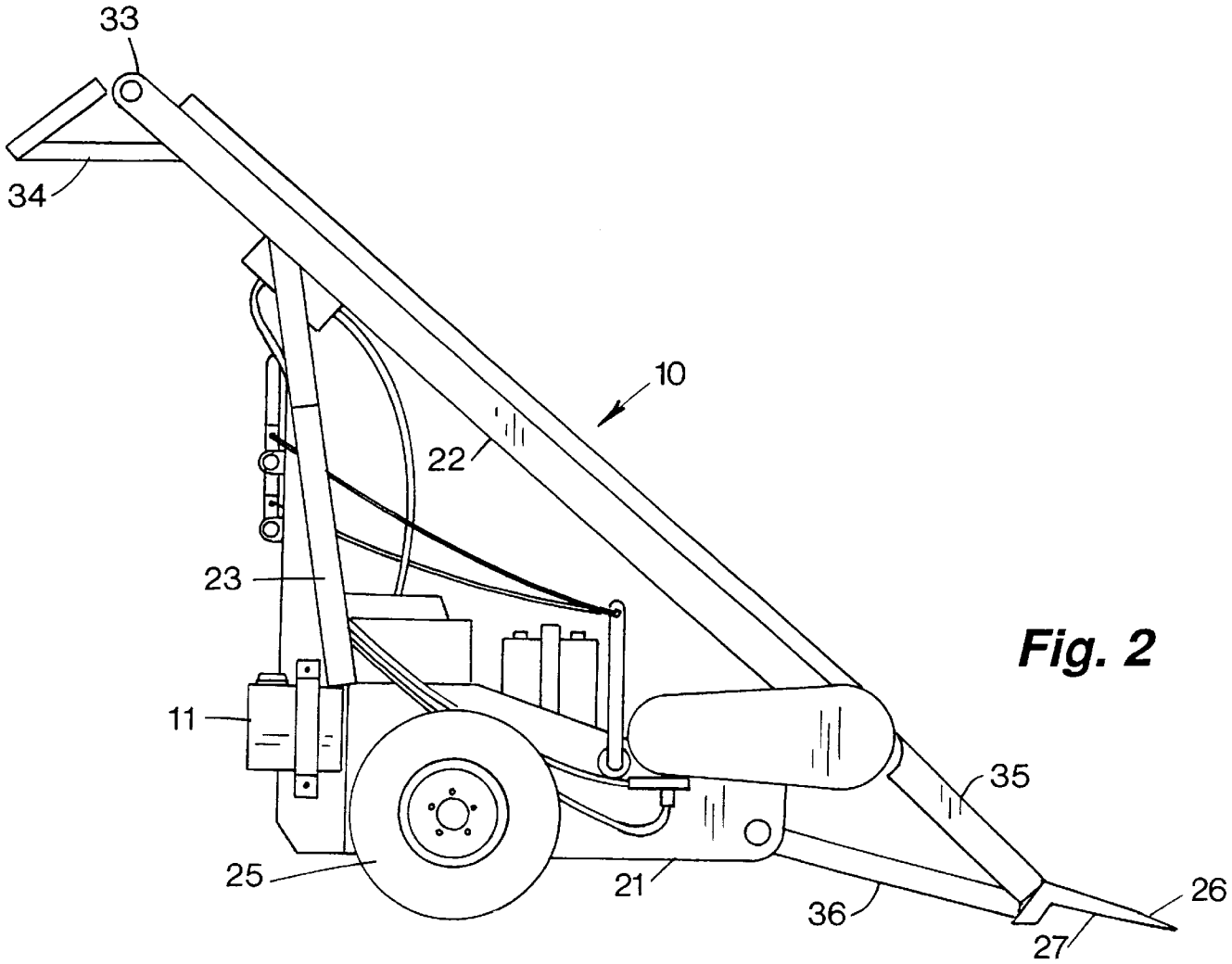
FIG. 2 is a side elevation view of the machine according to FIG. 1.
Figure 3:
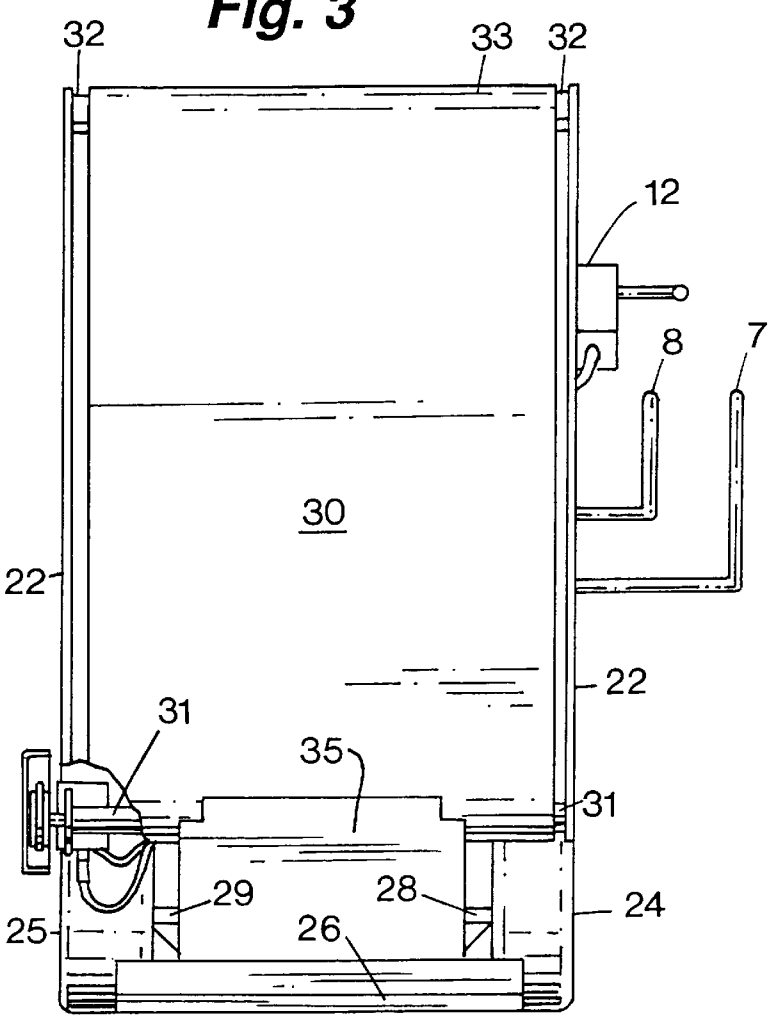
FIG. 3 is a frontal view of the machine according to FIG. 1 with a breakout showing the hydraulic motor for driving the conveyor belt.

In the drawings, a machine for removing and loading roofing material is referred to generally by the numeral 10. The machine comprises a conveyor belt 30, a chute 34, a hydraulic power system, and a generally triangular frame having three members: a horizontal member 21, an inclined member 22 and a vertical member 23. Two wheels 24, 25 are rotatably connected to a rearward portion of the horizontal frame member 21 by two independent axles 28, 29, respectively (FIG. 3). Attached to the leading edge of the horizontal member 21 are two arms 36 which together support a short ramp 35 and an elongated chisel-like front member 26 (FIG. 2). Structural supports for the inclined member 22 include the vertical member 23, the arm 36 and the front member 26, the underside 27 of which rests on the roof deck when the machine 10 is in operation (FIGS. 1 and 2).

Means for movably attaching the conveyor belt 30 to the inclined member 22 includes front and rear axles 31 and 32. In use, the distal end 33 of the conveyor 30 is situated above the roof surface at an ample height for a cart 40 to be placed under the end 33 (FIG. 1). The chute 34, which is rigidly attached to the upper portions of the frame members 22, is employed to direct removed roofing material 41 into the cart 40.

Figure 4:
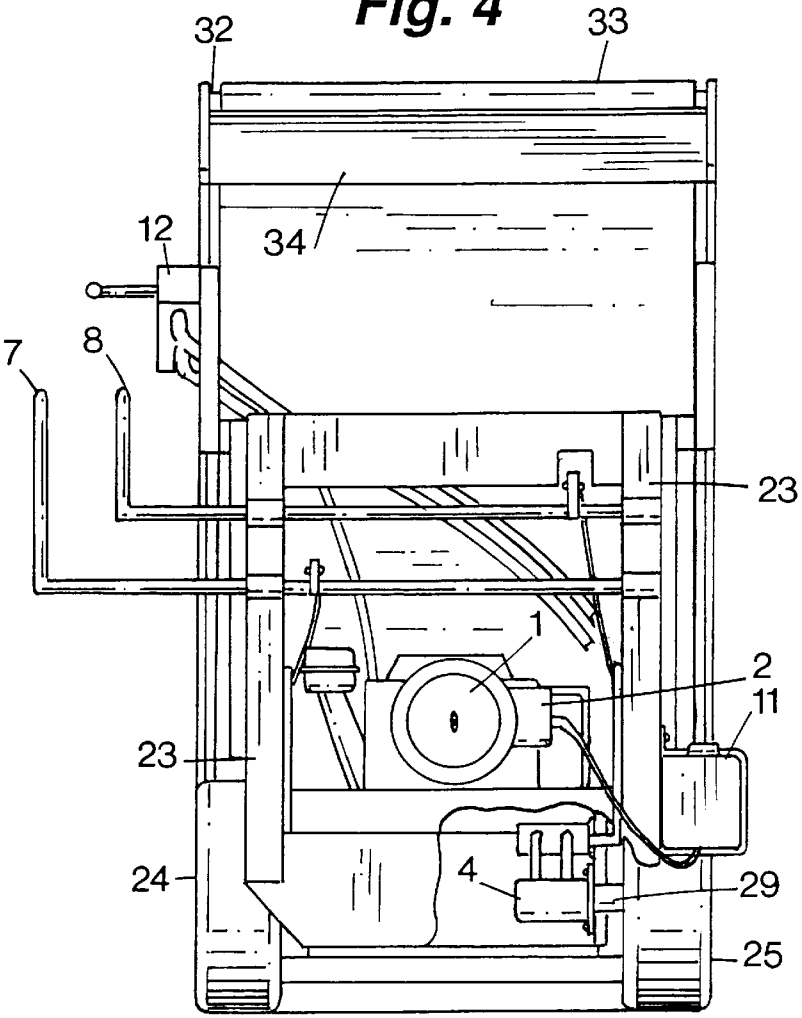
FIG. 4 is a rear view of the machine according to FIG. 1.
Figure 6:
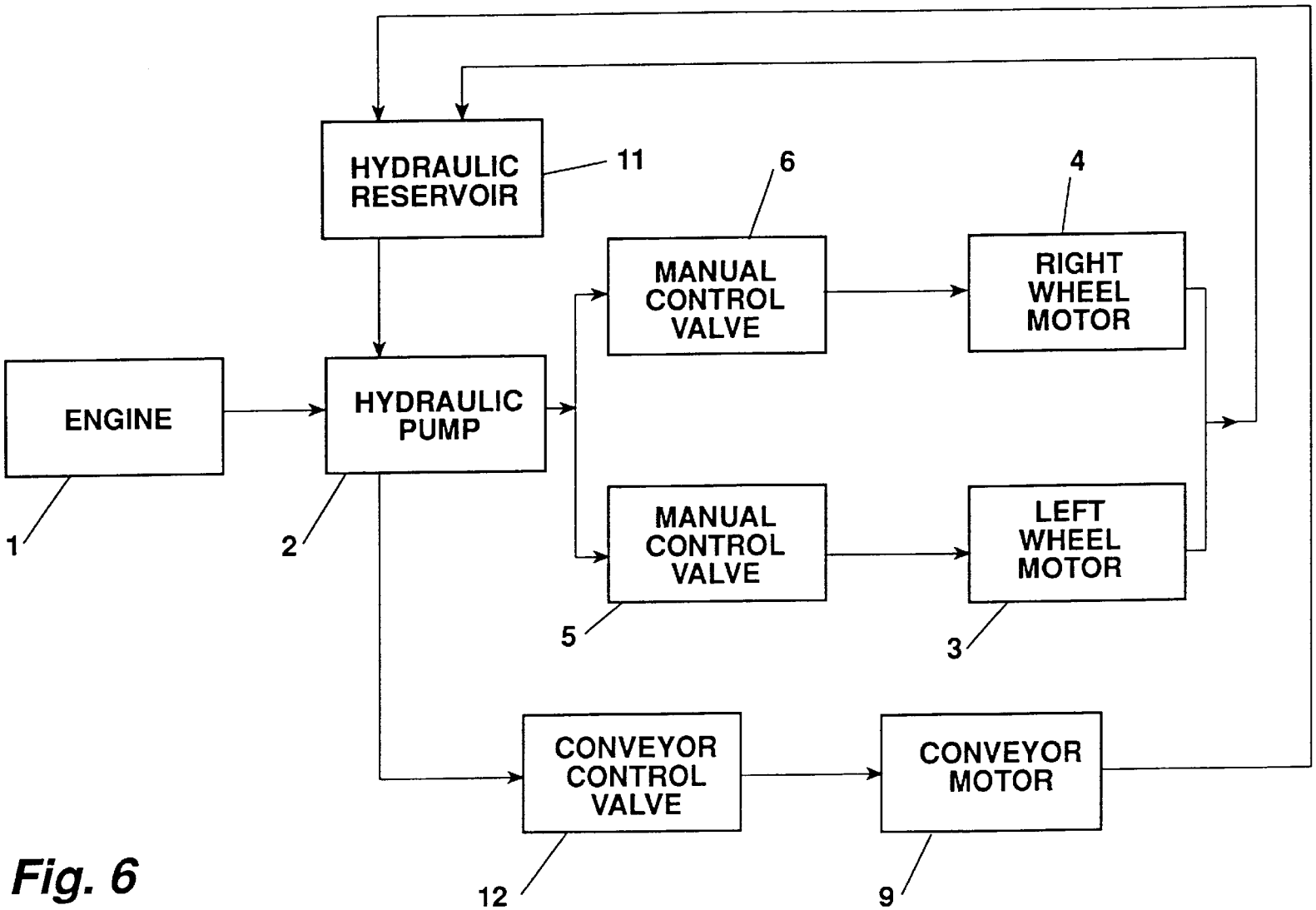
FIG. 6 is a schematic diagram of the hydraulic power and control system.

In its preferred embodiment, the hydraulic power system of the machine 10 includes an internal combustion engine 1 mounted on the rearward section of the horizontal member 21 in the vicinity of the wheel axles 28, 29 (FIGS. 4, 6). A suitable engine 1 is the 16 horsepower, Kohler Horizontal Shaft Engine, Model #K341AQS-71355. The hydraulic power system also comprises a hydraulic pump 2 directly driven by the engine 1 and connected to a hydraulic motor 3, 4 for each wheel 24, 25 (FIG. 4). Preferably, the hydraulic motors 3, 4 are mechanically connected directly to the wheel axles 28, 29, respectively. Flow of hydraulic fluid from a reservoir 11 to the hydraulic motors 3, 4 is controlled by hydraulic valves 5, 6, respectively, which regulate the speed of the motors and determine whether they go forward or in reverse (FIG. 6). Alternately, the hydraulic pump 2 and control valves 5, 6 are incorporated into the same unit.

In use, the operator holds a pair of handles for control levers 7, 8 which are linked to the control valves 5, 6, respectively (FIGS. 4 and 6). When he pushes both levers 7, 8 forward, the wheels 24, 25 turn in a forward direction; and the harder he pushes, the faster these wheels turn. On the other hand, when the operator pulls both levers 7, 8 backward, the wheels 24, 25 turn in a backward direction and the harder he pulls, the faster the machine 10 travels in reverse. The operating speed of the machine 10 can also be controlled with the use of a hand throttle control (not shown) on the carburetor of the engine 1.

Turning the machine 10 in a very short radius can be accomplished by simultaneously pushing one of the levers 7, 8 forward and the other in reverse. Once the operator lets go of the levers 7, 8, the machine 10 comes to a complete rest.

Figure 5:
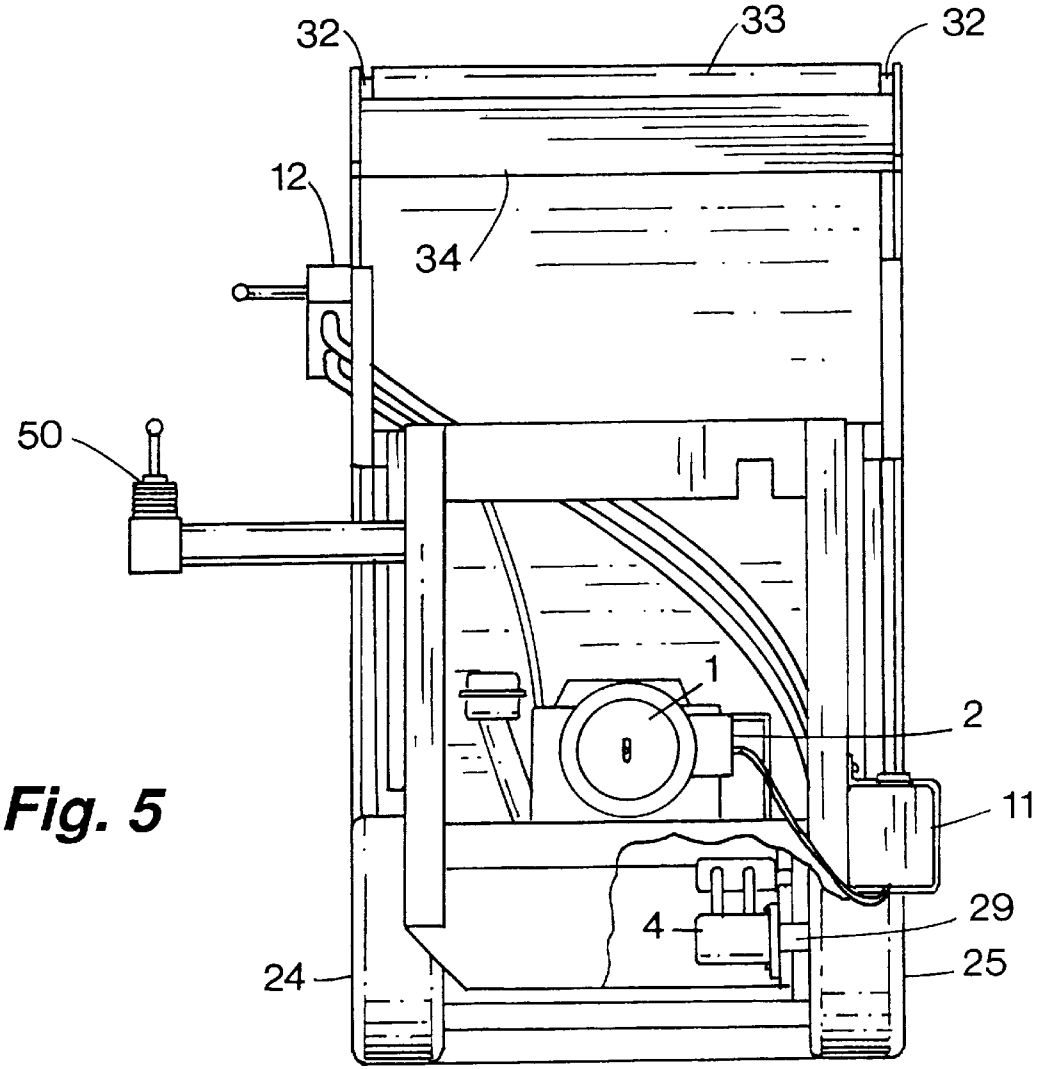
FIG. 5 is a rear view of an alternate embodiment of the machine which uses a joy stick control.

In an alternate embodiment illustrated in FIG. 5, the control handles 7, 8 are replaced with a single joy stick 50 such as the two spool control valve manufactured by Prince, Model No. RD522CC.

The hydraulic power system in the machine 10 further comprises a hydraulic motor 9 which is mechanically linked to the front axle 31 by a sprocket and chain drive (FIG. 3). The hydraulic motor 9 is supplied by the hydraulic pump 2 and discharges into the reservoir 11. A manual control valve 12 is employed to regulate the direction in which the hydraulic motor 9 moves the conveyor belt 30, as well as to reverse this direction and to control the belt speed. Like the joy stick of the alternate embodiment illustrated in FIG. 5, the manual control valve 12 can also be converted to remote control.

Components which have found to be satisfactory for use in the machine 10 are shown in the following table:

Engine: 16 horse-power Kohler Horizontal Shaft Engine, Model No. K341AQS-71355

Hydraulic Pump: Sunstrand, Model No. M25 Tandum Pump

Hydrostatic Transmission: Eaton, Model No. 1100-047

Hydraulic Motors: Danfloss, Model No. 151-F2107

Hydraulic Reservoir: 10 gallon EATON, Model No. RES-10S

Conveyor Belt: Main Belt, Model No. MH36X198RTBELT

Method of Operation

In operation, the machine 10 is moved into position on a roof; and the old roofing material is cut in place, using a portable circular saw or the like, so as to score this material in pieces 41 measuring about 3 feet square. Next the chisel-like front member 26 is inserted beneath the edge of one of these roofing sections. Once the cart 40 has been positioned proximate with the rear of the machine 10 so that it can catch the roofing pieces 41 as they are discarded from the conveyor belt 30 and chute 34, the operator then brings the engine 1 to its operating speed by properly throttling it.

With his body positioned to the left rear of the machine 10, the operator sets the conveyor belt 30 in motion by pushing the manual control valve 12. Next he pushes the control levers 7, 8 to move the machine 10 forward, thereby wedging the chisel-like front member 26 between the roofing material 41 and the roof deck. As the machine 10 moves forward, the chisel-like front member 26 simultaneously pries loose the roofing material 41 and rips it from the roof deck. The separated roofing material 41 is then forced onto the conveyor belt 30. In this way, large pieces of old roofing material 41 can be separated from the roof deck and made to move up the conveyor belt 30. At the distal end 33 of the belt 30, the material 41 falls off and is guided by the chute 34 into the cart 40. As soon as the machine 10 has filled the cart 40, an empty cart 40 must be brought in to replace it so that additional old roofing pieces 41 can be collected while the other cart is being dumped at the edge of the roof. In tests, it has been demonstrated that the machine 10 can be used to remove and load old roofing material at a rate of about 2000 square feet of roof surface per hour.

It is understood that those skilled in the art may conceive other applications, modifications and/or changes in the invention described above. Any such applications, modifications or changes which fall within the purview of the description are intended to be illustrative and not intended to be limitative. The scope of the invention is limited only by the scope of the claims appended hereto.

It is claimed:

1. A machine for removing, in large pieces, old roofing material in the form of built-up composite from a roof deck and placing the removed roofing material into a cart for disposal, comprising:

(a) a wheeled frame;

(b) a lower front member attached to the wheeled frame, the lower front member including a blade and a heel which diverges rearwardly therefrom, the blade and the heel defining a structure which opens downwardly, the blade having a chisel-like edge and a generally flat upper surface which extends rearwardly thereof, the chisel-like edge having an upper face, the upper face having a greater upward slope than the flat upper surface, the chisel-like edge, during use, remaining generally fixed in position with respect to the wheeled frame;

(c) means, including two power driven wheels, for simultaneously moving the frame and the lower front member forward, so that the chisel-like edge of the front member can be forced between the old roofing material and the roof deck, prying off the roofing material;

(d) means for automatically conveying the old roofing material, once it has been pried off, from the roof deck to the cart; and (e) means for independently controlling speed and direction of rotation of each of the power driven wheels, so that the wheeled frame can be moved within a very short turning radius.

2. The machine according to claim 1 which further comprises the wheeled frame having three frame members which are rigidly fastened together so as to define a structure which is generally triangular in shape, said three frame members including an inclined member and two frame members disposed perpendicularly to each other, distal ends of the inclined member being supported by the lower front member and by one of said two frame members which extends generally vertically and rearwardly of points on the structure at which one of the wheels is rotatably connected thereto, so that in use the structure pivots downwardly about said points and rests on the chisel-like edge of the front member, thereby enhancing forces tending to wedge the edge between the roofing material and the roof deck.

3. A machine for removing old roofing material which has been prescored from a roof deck and placing the removed roofing material into a cart for disposal, comprising:

(a) an elongated, lower front member for wedging between the roofing material and the roof deck, the front member including a blade and a heel which diverges rearwardly therefrom, the blade and the heel defining a structure which opens downwardly, the blade having a chisel-like edge;

(b) a wheeled frame to which the front member is attached, the chisel-like edge, during use, remaining generally fixed in position with respect to the wheeled frame;

(c) means, including the wheeled frame, for moving the front member forward, so that it can be used to pry off old roofing material from the roof deck;

(d) a chute which is connected to the wheeled frame and located upwardly and rearwardly of the chisel-like edge; and (e) means for automatically conveying the old roofing material to the chute, so that the old roofing material can be placed in the cart.

* * * * *